United States Patent [19]

Mandai et al.

[11] Patent Number: 4,480,987

[45] Date of Patent: Nov. 6, 1984

[54] COMBUSTION APPARATUS FOR LIQUID FUELS

[75] Inventors: Tomomasa Mandai, Nara; Hiromi Ohta, Ikoma; Tadashi Yamazaki, Nara; Yoshihisa Urakawa, Yamato-kohriyama, all of Japan

[73] Assignee: Matsushita Electric Industrial Co., Ltd., Osaka, Japan

[21] Appl. No.: 461,237

[22] Filed: Jan. 26, 1983

[30] Foreign Application Priority Data

Feb. 1, 1982 [JP] Japan ..... 57-15101
Feb. 10, 1982 [JP] Japan ..... 57-20002
Feb. 17, 1982 [JP] Japan ..... 57-24742

[51] Int. Cl.[3] ..... F23D 3/18

[52] U.S. Cl. ..... 431/304; 431/309; 431/346; 126/96

[58] Field of Search ..... 431/33, 88, 144, 145, 431/200, 201, 203, 204, 252, 302–310, 320, 344, 346; 126/96, 97

[56] References Cited

U.S. PATENT DOCUMENTS 4,363,620 12/1982 Nakamura et al. ..... 431/307 X

FOREIGN PATENT DOCUMENTS 52-18736 4/1977 Japan .

*Primary Examiner*—Margaret A. Focarino
*Attorney, Agent, or Firm*—Joseph W. Farley

[57] ABSTRACT

A wick-type combustion apparatus for liquid fuels comprises: a pair of cylindrical walls extending vertically and opposed to each other with a gap; a cylindrical wick vertically movable as guided between and along the walls; a slit-form cylindrical fuel passage opening provided in the outer wall and adapted to be opened and closed by the descent and ascent, respectively, of the wick; a fuel trap chamber provided around the opening in communication therewith; and a cylindrical porous member vertically extending in the chamber.

A flame or flames remaining after the descent of the wick can be instantaneously blown out by a blast of an explosive combustion which occurs in the fuel trap chamber. The porous member serves to reduce the amount of unburnt fuel used for the explosive combustion, so that an abnormal rise of flame or flames attendant with the explosion can be prevented.

5 Claims, 10 Drawing Figures

COMBUSTION APPARATUS FOR LIQUID FUELS

The present invention relates to a combustion apparatus for liquid fuels, such as kerosene, and more particularly to a wick-type combustion apparatus which is provided with means for quickly extinguishing a flame or flames remaining after turning off the apparatus.

A typical wick-type combustion apparatus incorporating such accelerated flame extinction means comprises an opposed pair of vertically extending cylindrical walls, a cylindrical wick vertically movable between and along the opposed walls, a slit-form cylindrical fuel passage opening provided in the outer wall and adapted to be opened and closed by the descent and ascent, respectively of the wick, and a cylindrical fuel trap chamber disposed around the opening and provided with ventilation holes for allowing thereinto of ambient air. When the wick is lowered in an attempt to turn off the apparatus, the unburnt gaseous fuel evaporated from the wick enters the fuel trap chamber and mixes with the air inflowing through the ventilation holes. The mixture upon reaching the combustible level (the air-fuel mixture ratio at which combustion can take place) is ignited by a flame or flames remaining between the opposed walls and explosively burns in a flash, so that the remaining flame or flames will be blown out by the blast of such an explosive combustion. With the arrangement of this conventional apparatus, however, since the combustion occurring in the fuel trap chamber instantaneously propagates to the unburnt gaseous fuel staying above the lowered wick for the reason to be described later with reference to one of the accompanying drawings, an abnormal rise of flame or flames is temporarily formed, giving an apprehension to users as well as producing soot due to air-deficient combustion.

It is therefore an object of the present invention to provide a combustion apparatus for liquid fuels incorporating blast-blow-out-type flame extinction means which is free from an abnormal rise of flame or flames.

In order to fulfill this object, the present invention provides a combustion apparatus for liquid fuels comprising:

two cylindrical wall means extending upwardly and opposed to each other with a gap, wick means movable up and down as guided between and along said wall means, a burning zone formed above said wall means, fuel passage opening means provided in at least one of said wall means and adapted to be opened and closed by the descent and ascent, respectively, of said wick means, fuel trap chamber means provided on one side of said opening means remote from said wick means, and a cylindrical porous member upwardly extending within said chamber means.

Figure 1:
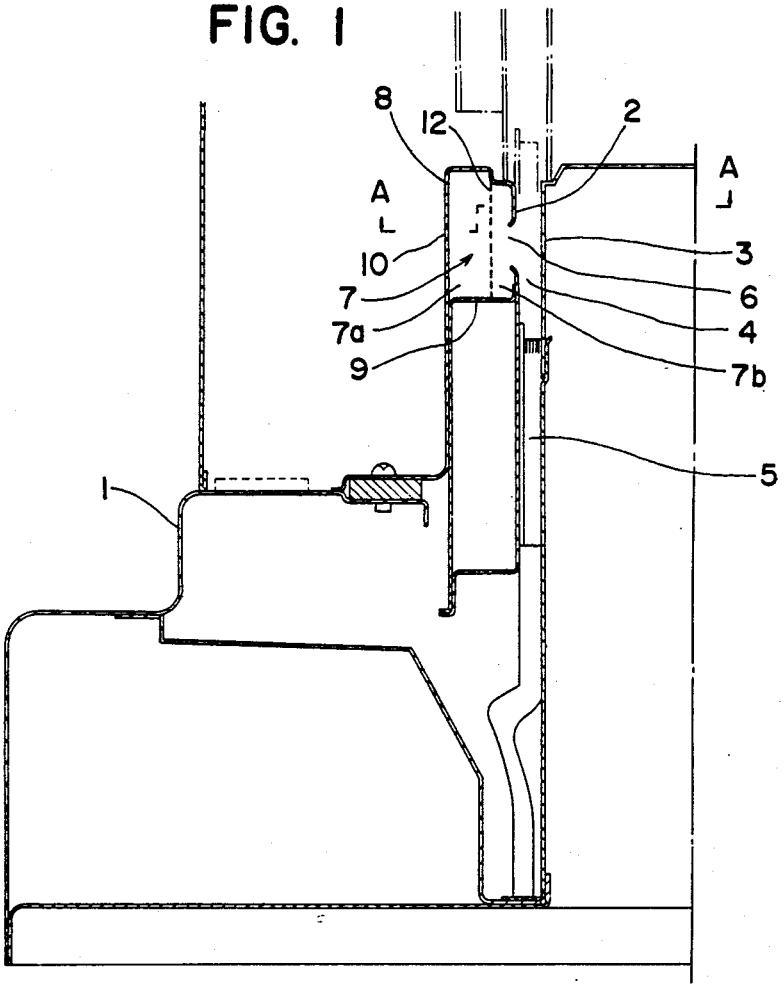
Figure 2:
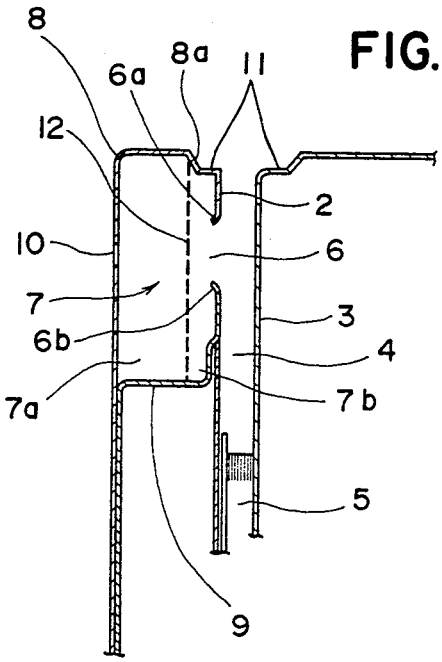
Figure 3:
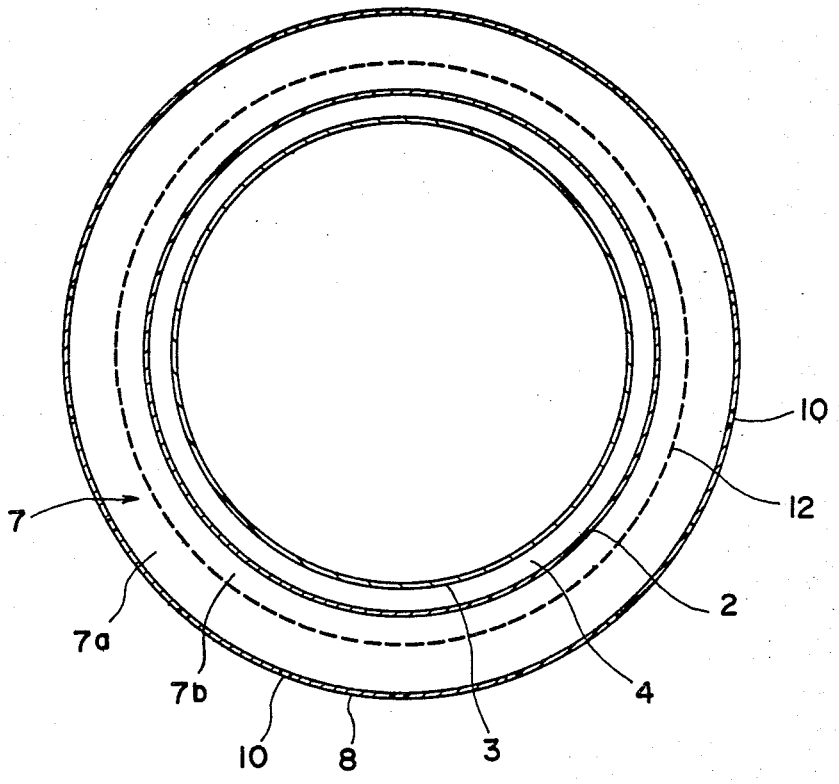
Figure 4:
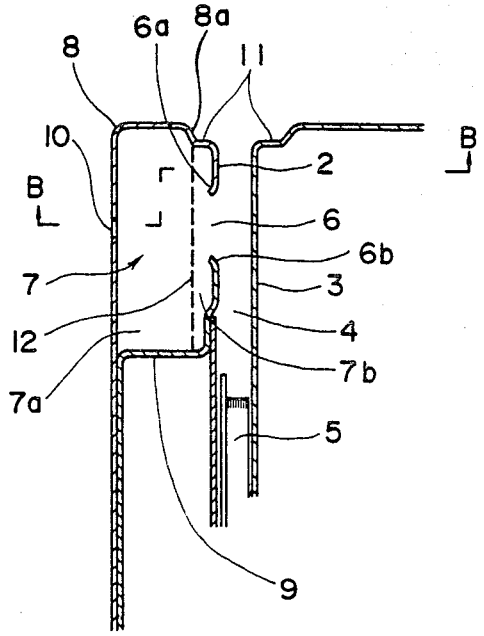
Figure 5:
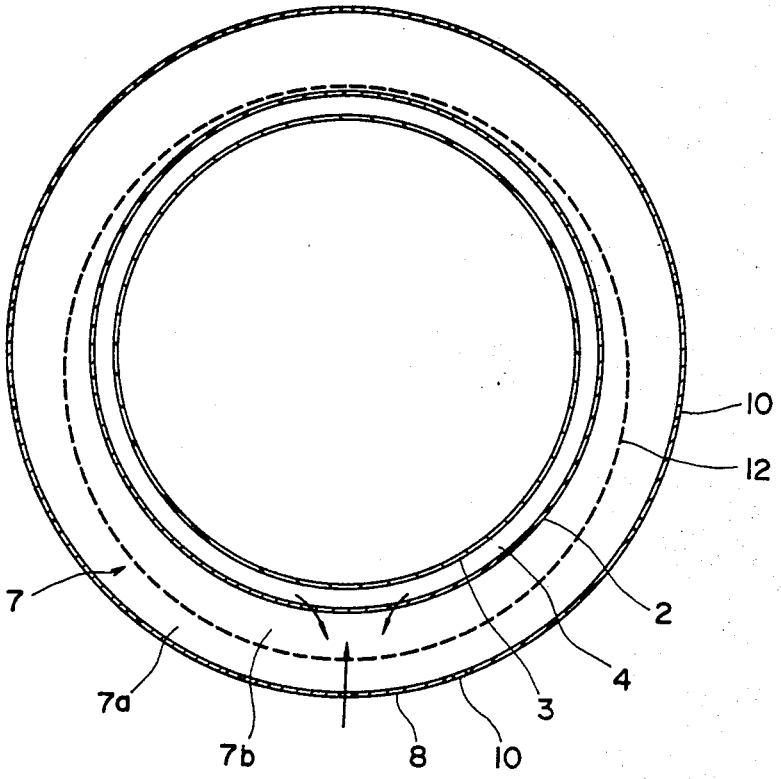
Figure 6:
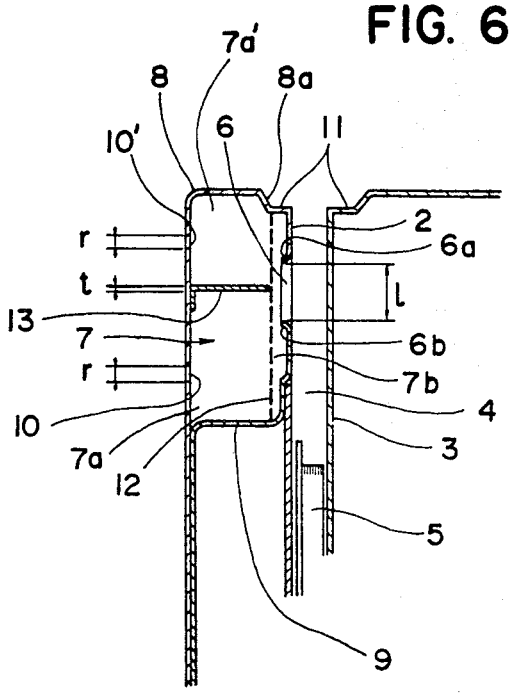
Figure 7:
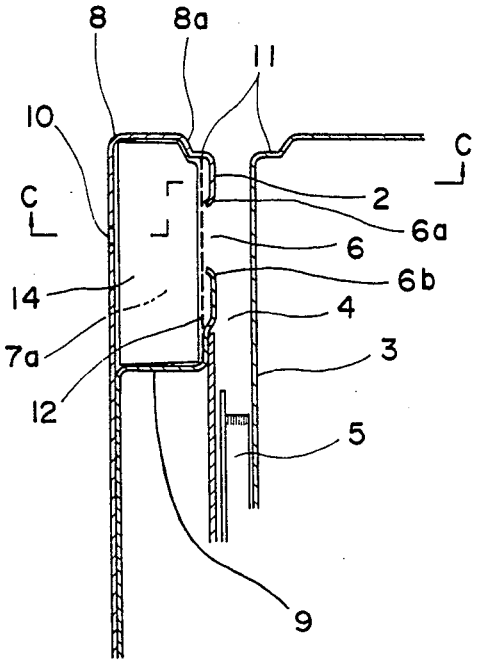
Figure 8:
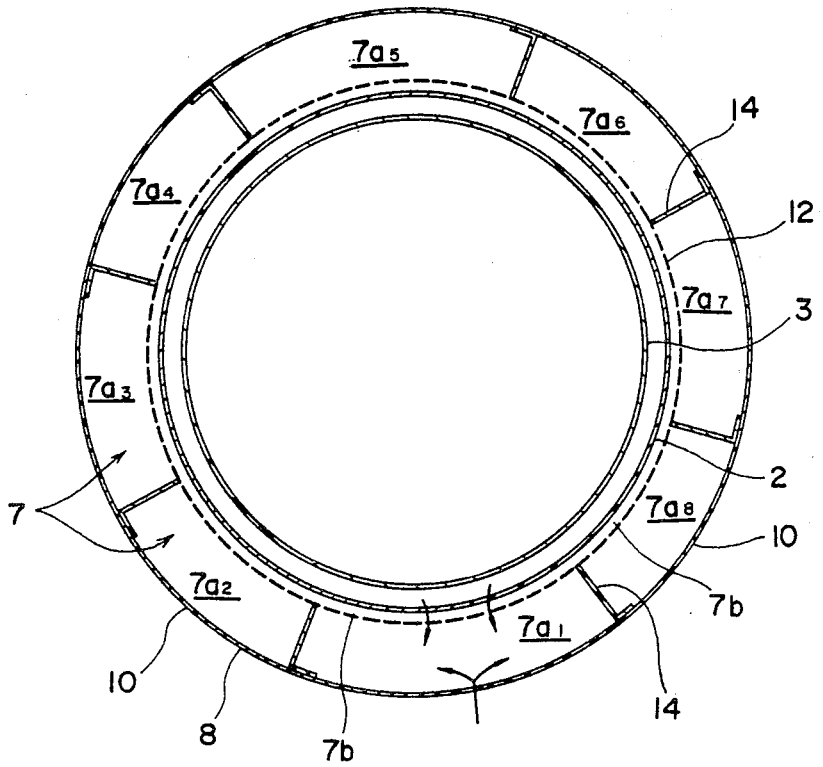
Figure 9:
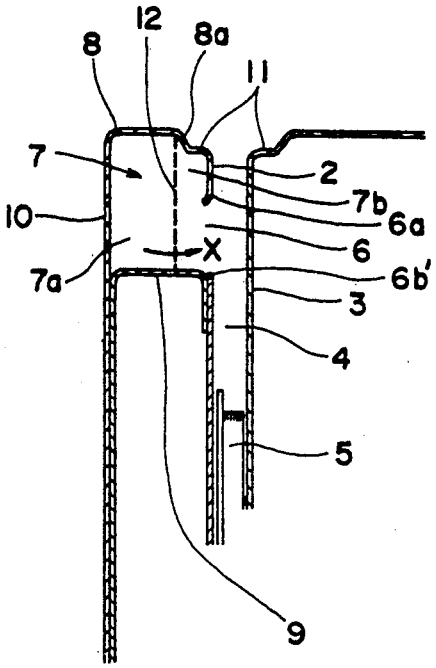
Figure 10:
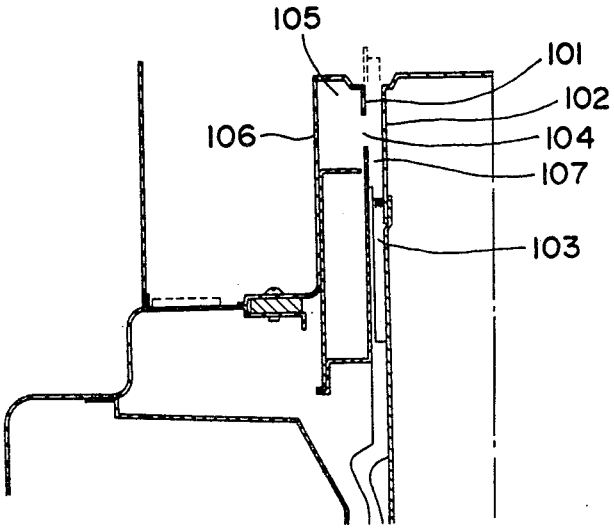
FIG. 10 PRIOR ART

Various features and effects of the present invention will become apparent from the following description of embodiments given with reference to the accompanying drawings, in which;

FIG. 1 is a sectional side view showing a half of a combustion apparatus embodying the invention, FIG. 2 is an enlarged fragmentary view showing the principal portion of the same, FIG. 3 is a view in section taken on the lines A—A in FIG. 1, FIG. 4 is a fragmentary sectional side view showing the principal portion of another combustion apparatus embodying the invention, FIG. 5 is a view in section taken on the lines B—B in FIG. 4, FIG. 6 is a fragmentary sectional side view showing the principal portion of still another combustion apparatus embodying the invention, FIG. 7 is a fragmentary sectional side view showing the principal portion of still another combustion apparatus embodying the invention, FIG. 8 is a view in section taken on the lines C—C in FIG. 7, FIG. 9 is a fragmentary sectional side view showing the principal portion of a still further combustion apparatus embodying the invention, and FIG. 10 is a fragmentary sectional side view showing the principal portion of a conventional combustion apparatus.

Before describing the embodiments of the invention, the concrete arrangement of the typical conventional combustor will be described with reference to FIG. 10. The combustor, as shown and described hereinbefore, comprises an opposed pair of vertically extending cylindrical walls 101 and 102, a vertically movable cylindrical wick 103, a cylindrical fuel passage slit 104 formed in the outer wall 101, and a cylindrical fuel trap chamber 105 disposed around the slit 104 and provided with ventilation holes 106. In this combustor, a flame or flames remaining in the space 107 between the walls 101 and 102 after descent of the wick 103 can be blown out by the blast of an explosive combustion which occurs in the fuel trap chamber 105. This explosive combustion, on the other hand, transmits instantaneously to the unburnt gaseous fuel remaining in the space 107, temporarily forming an abnormal rise of a flame or flames as described before.

As a result of repeated experiments, this temporary formation of an abnormally large flame or flames was first believed attributable to an unduly large explosion energy due to the large volume of the fuel trap chamber 105. Thus the volume of the fuel trap chamber 105 was reduced in an attempt to avoid an attendant abnormal flame formation. The result, however, was the same since an explosive combustion took place also in the space 107 which contained increased gaseous fuel evaporated from the lowered wick 103. It can be therefore concluded that unburnt gaseous fuel is produced in a large amount by the lowered wick 103 upon turning off the combustion apparatus, and the aforesaid abnormal flame formation is caused if such a large amount of unburnt fuel is totally burnt explosively.

The present invention which has overcome this problem will now be described with reference to FIGS. 1 to 9.

Referring to FIGS. 1 to 3 illustrating a first embodiment of the invention, a cylindrical fuel tank 1 contains a liquid fuel. An outer cylindrical wall 2 and an inner cylindrical wall 3 vertically extend from the tank 1 and are opposed to each other with a wick accommodating space 4 formed therebetween. A cylindrical wick 5 has a lower end immersed in the liquid fuel within the tank 1 and an upper end movably guided between and along the cylindrical walls 2 and 3. A slit-form cylindrical fuel passage opening 6 is formed in the outer wall 2 and adapted to be opened and closed by the descent and ascent, respectively, of the wick 5. Outwardly of and in communication with the opening 6 is arranged a cylindrical fuel trap chamber 7 defined by chamber forming members 8 and 9. The chamber forming member 8 is formed with a plurality of ventilation holes 10 arranged at equal spacing around the chamber 7 for allowing thereinto of ambient air. A burning zone is formed above a tray 11 provided at the upper ends of the cylindrical walls 2 and 3. The fuel passage opening 6 has upper and lower edges bent into the chamber 7.

The arrangement of the combustion apparatus so far described is substantially the same as that of the conventional combustion apparatus illustrated in FIG. 10. However, the apparatus of the invention further comprises a cylindrical porous member 12, such as a USU 304 15-mesh metallic screen 0.7 mm in wire diameter, disposed in the chamber 7 to divide it into outer and inner subchambers *7a* and *7b*. The porous member 12 is held in place by its engagement with a step *8a* of the chamber forming member 8, but may of course be otherwise held.

In use for heating purpose, the wick 5 is in its raised position as indicated in phantom lines, and the liquid fuel in the tank 1 is drawn up by the wick 5 and evaporated from the upper end thereof. The gasified fuel is burnt in the combustion zone above the tray 11.

If, on the other hand, the wick 5 is lowered, as indicated in solid lines, to turn off the apparatus, the fuel passage opening 6 is opened, and the majority of unburnt gaseous fuel still evaporated from the wick 5 by the remaining heat is allowed into the inner subchamber *7b* through the opening 6 and further into the outer subchamber *7a* through the porous member 12. A remaining flame (or flames) having been lowered into the wick accommodating space 4 along with the descent of the wick 5 ignites the fuel gas trapped in the inner subchamber *7b* to cause an explosive combustion thereof, consequently blowing out the remaining flame in the space 4. At this time, since propagation of said explosive combustion to the gaseous fuel trapped in the outer chamber *7a* is shielded by the porous member 12, the explosion energy of such a combustion, though sufficient to blow out the remaining flame, is relatively small. Thus this explosive combustion does not lead to formation of an abnormally large flame or flames by contingent ignition of the fuel gas remaining in the space 4 nor to production of soot attendant therewith although the fuel in the space 4 is in fact burnt to some extent with a small flame or flames to produce an acceptable amount of soot.

Since the fuel evaporated from the lowered wick 5 mainly enters into the fuel trap chamber 7 and does not overflow the tray 11, a flame or flames formed above the lowered wick 5 will not extend over the tray 11. Thus the likelihood of a fire hazard upon the apparatus falling down will be greatly reduced. It is to be understood that the inflow of the gaseous fuel into the chamber 7 is assisted by a negative pressure produced by the venturi effect at the bent edges *6a* and *6b* of the opening 6, the bent edges further serving to allow smooth vertical movement of the wick 5.

FIGS. 4 and 5 show a second embodiment of the invention which is adapted for reliable flame extinction particularly when the apparatus falls down. The apparatus illustrated comprises a cylindrical porous member 12 disposed radially movably within the fuel trap chamber 7. Otherwise, the apparatus corresponds in arrangement to the one illustrated in FIGS. 1 to 3.

When the apparatus topples down, the remaining unburnt fuel evaporated from the wick 5 lowered automatically by an unillustrated mechanism collects at one side of the apparatus (that side of the apparatus closer to the floor), consequently requiring a locally intense blast to blow out a flame or flames remaining locally in the space 4. In this embodiment, the porous member 12 moves sidewise, i.e., downward, upon toppling of the apparatus to locally increase the volume of the inner subchamber *7b* as shown in FIG. 5. Thus a larger explosion energy produced in the enlarged zone of the inner subchamber *7b* serves to reliably blow out the remaining flame or flames. It should be understood that the increased explosion energy, though sufficient for the desired flame extinction, can be maintained still sufficiently low by the division, by the porous member 12, of the chamber 7 into the subchambers *7a* and *7b*, so that an abnormal rise of a flame or flames can be avoided.

FIG. 6 shows a third embodiment of the invention in which a horizontal partition plate 13 is provided in the fuel trap chamber 7 to reduce the time needed for complete flame extinction. The partition plate 13 has one end fixed to the chamber forming member 8 as by welding and the other end directed toward the fuel passage opening 6. Thus a lower subchamber *7a* and an upper subchamber *7a'* are formed outwardly of the inner subchamber *7b*. Ventilation holes 10 and 10' are formed in the chamber forming member 8 for the respective outer subchambers *7a* and *7a'*.

With the apparatus having the above arrangement, if the wick 5 is lowered to turn off the apparatus, a remaining flame or flames having descended along with the descent of the wick 5 will be blown out, as in the case of the apparatus of FIGS. 1 to 3, by a blast of an explosive combustion which takes place in the inner subchamber *7b*. Such an explosive combustion, unlike the conventional apparatus or the apparatus of FIGS. 1 to 3 for that matter, does not cause ignition of the unburnt gaseous fuel in the space 4 by the presence of the partition plate 13, consequently decreasing the time required for complete flame extinction. The reason for this, though not known for certainty, is believed that the partition plate 13 cooperates with the porous member 12 to increase resistance to flame propagation from the inner subchamber *7b* to the space 4. It should be noted here that the partition plate 13 also serves to increase resistance to flame propagation from the inner subchamber *7b* to the outer subchambers *7a* and *7a'*, thus assisting the shielding effect of the porous member 12.

The partition plate 13 may not necessarily be used in combination with the porous member 12 but alone can fulfill the contemplated function to certain degree. Further an obliquely extending partition plate can substitute the horizontal partition plate 13. Still further, a plurality of partition plates may be arranged to divide the chamber 7 into three or more compartments.

To mention the numerical values of some components of the apparatus used for experimentation, by way of example, the width l of the opening 4 is 10 mm; the thickness of the partition plate 13 is 0.6 mm; the porous member is a USU 304 15-mesh metallic screen 0.7 mm in wire thickness; and the ventilation holes 10 and 10' are 1.5 mm in diameter and 10 (each row) in number.

In the fourth embodiment shown in FIGS. 7 and 8, vertical partition plates 14 are disposed in the outer subchamber *7a*to divide it into a plurality (8 in this embodiment) of circumferentially separated compartments $7a_1$ to $7a_8$. Each compartment is provided with a ventilation hole 10.

Although quite unlikely, an explosive combustion occurring in the inner subchamber 7b could accidentally induce combustion somewhere in the outer subchamber 7a in spite of the shielding effect of the porous member 12. The combustion thus initiated would last long if allowed to propagate circumferentially within the entire outer subchamber 7a, consequently prolonging the time required for complete flame extinction. In the illustrated embodiment, however, propagation of such combustion can be confined by two adjacent partition plates 14 to one particular compartment, e.g., compartment $7a_1$, thereby reducing the time for complete flame extinction. Though dispensable, the ventilation holes 10 should be provided to shorten the time required for the thus initiated combustion to complete.

In another embodiment shown in FIG. 9, the bottom of the fuel trap chamber 7 is positioned substantially at the same level as the lower edge 6b' of the fuel passage opening 6. The lower edge 6b' of the fuel passage opening 6 may be straight as illustrated or bent into the chamber 7 as in the foregoing embodiments.

After an explosive combustion in the inner subchamber 7b to blow out a flame or flames remaining in the space 4, the unburnt gaseous fuel in the outer subchamber 7a flows reversely toward the opening 6 as indicated by the arrow X, and the reverse fuel flow X in turn forms a whirl at the lower edge of the opening 6 if the lower edge of the opening 6 is positioned above the bottom of the chamber 7. It has been found that if the explosive combustion accidentally has failed to blow out the remaining flame or flames, the flame or flames will linger at the opening 6 for prolonged time due to the aforesaid fuel whirl. In the illustrated embodiment, however, since the lower edge 6b' of the opening 6 is positioned substantially at the same level as the bottom of the chamber 7, the gaseous fuel remaining in the outer subchamber 7a, after an explosive combustion in the inner subchamber 7b, flows smoothly in reverse direction without formation of a whirl at the opening 6. Thus, even if the explosion blast has failed in flame extiction, the remaining flame or flames cannot stay long, consequently shortening the time necessary for complete flame extinction.

Although a metallic screen has been described as an example of a porous member throughout the embodiments, a perforated plate, a metallic sponge plate or the like may also be used.

What is claimed is:

1. A combustion apparatus for liquid fuels comprising;

inner and outer cylindrical wall means extending substantially vertically and opposed to each other with a gap therebetween, wick means movable up and down as guided between and along said wall means, a burning zone formed above said wall means, fuel passage opening means provided in said outer wall means and adapted to be opened and closed by the descent and ascent, respectively, of said wick means, fuel trap chamber means provided on one side of said opening means remote from said wick means, and a cylindrical porous member extending substantially vertically within said chamber means.

2. A combustion apparatus as defined in claim 1 wherein said chamber means is provided with ventilation holes for introducing air therethrough into said chamber means.

3. A combustion apparatus as defined in claim 1 wherein partition plate means is provided within said chamber means to divide said chamber means in vertical direction.

4. A combustion apparatus as defined in claim 1 wherein said fuel passage opening means has marginal edges bent into said chamber means.

5. A combustion apparatus as defined in claim 1 wherein said fuel passage opening means is provided in the form of a circumferentially extending slit.

* * * * *